US007661612B2

(12) United States Patent
Lee et al.

(10) Patent No.: US 7,661,612 B2
(45) Date of Patent: Feb. 16, 2010

(54) SHREDDER

(75) Inventors: Pei-Yuan Lee, Taipei (TW); Shin-Fu Lin, Taipei (TW)

(73) Assignee: Primax Electronics Ltd., Taipei (TW)

( * ) Notice: Subject to any disclaimer, the term of this patent is extended or adjusted under 35 U.S.C. 154(b) by 287 days.

(21) Appl. No.: 11/625,518

(22) Filed: Jan. 22, 2007

(65) Prior Publication Data

US 2008/0093487 A1 Apr. 24, 2008

(51) Int. Cl.

| | |
|---|---|
| ***B02C 4/32*** | (2006.01) |
| ***B02C 7/14*** | (2006.01) |
| ***B02C 9/04*** | (2006.01) |
| ***B02C 11/08*** | (2006.01) |

(52) U.S. Cl. ..... 241/36; 241/100; 241/236

(58) Field of Classification Search ..... 241/36, 241/100, 236

See application file for complete search history.

(56) References Cited

U.S. PATENT DOCUMENTS

| | | | | |
|---|---|---|---|---|
| 5,984,215 | A * | 11/1999 | Huang | 241/36 |
| 6,250,574 | B1 * | 6/2001 | Wu Huang | 241/36 |
| 7,014,133 | B2 * | 3/2006 | Ho | 241/36 |

* cited by examiner

*Primary Examiner*—Bena Miller
(74) *Attorney, Agent, or Firm*—Kirton & McConkie; Evan R. Witt

(57) ABSTRACT

The present invention relates to a shredder having a thickness triggering device. During the shredding operation, the trembling of the article is minimized or eliminated by using the shredder. The shredder includes a sustaining mechanism and a driving assembly. Since the sustaining mechanism is sustained against the shredding article, the amplitude of the trembling article is largely reduced. As a consequence, the influence of the shredding article on the thickness triggering device is reduced so as to prevent interruption of the shredder.

22 Claims, 6 Drawing Sheets

SHREDDER

FIELD OF THE INVENTION

The present invention relates to a shredder, and more particularly to a shredder having a thickness triggering device.

BACKGROUND OF THE INVENTION

Nowadays, shredders are used to cut articles. If a relatively thick article whose thickness is beyond an acceptable range, for example a thick paper or a compact disc, is shredded, the thick article is readily jammed. Under this circumstance, the shredder has a usage problem or even a breakdown. For avoiding the occurrence of jamming, a thickness triggering device is mounted in the shredder to determine whether the article to be shredded is beyond the acceptable range.

Referring to FIG. 1, a schematic perspective view of a shredder having a thickness triggering device is illustrated. The shredder 100 includes an entrance 101, a shredding path 102, a movable element 103, a thickness sensing module 104, a driving assembly 105, a transmission gear set 106 and a shredding knife assembly 107.

The entrance 101 is disposed above the shredding path 102. The movable element 103 is arranged at a side of the shredding path 102. The thickness sensing module 104 is disposed behind the movable element 103. As shown in FIG. 1, the thickness sensing module 104 includes a first optical sensor 1041 and a second optical sensor 1042. The thickness sensing module 104 and the movable element 103 are cooperatively referred as a thickness triggering device.

The shredding knife assembly 107 is disposed at the outlet of the shredding path 102. The transmission gear set 106 is interconnected between and engaged with the shredding knife assembly 107 and the driving assembly 105. As a consequence, the shredding knife assembly 107 is driven by the driving assembly 105 to implement a shredding operation.

The operation of the shredder 100 will be illustrated as follows. First of all, an article (not shown) to be shredded is introduced into the shredding path 102 through the entrance 101. When the article is in contact with and sustained against the movable element 103, the movable element 103 is shifted backwardly to result in a shift distance with respect to its original place. The first optical sensor 1041 and the second optical sensor 1042 of the thickness sensing module 104 continuously emit sensing light. In a case that the sensing light is not sheltered by the movable element 103, the article is permitted to feed through the shredding path 102 so as to perform a shredding operation. Whereas, if the sensing light is sheltered by the movable element 103, the shredding operation of the shredder 100 is interrupted.

That is, in the case that the shift distance of the movable element 103 is not sufficient to fully shelter the sensing light emitted from the first optical sensor 1041 and the second optical sensor 1042, the thickness of the article is acceptable. Under this circumstance, the article is continuously advanced in the shredding path 102. In addition, the shredder 100 has a shredding sensor (not shown) under the movable element 103. The shredding sensor may be a general optical sensor for sensing the article. When the advancing article approaches the shredding knife assembly 107, the shredding sensor will detect the presence of the article. Meanwhile, the transmission gear set 106 is driven by the driving assembly 105 and begins to rotate. Upon rotation of the transmission gear set 106, the shredding knife assembly 107 is driven to the implement a shredding operation.

As previously described, by using the movable element 103 and the thickness sensing module 104, the usage status of the shredder 100 may be determined according to the thickness of the article to be shredded. In other words, the movable element 103 and the thickness sensing module 104 are advantageous of avoiding the problem of causing jammed paper so as to extend the operating life of the shredder 100. However, this shredder 100 still has some drawbacks. For example, during the shredding operation, the article is readily suffered from trembling and the trembling article may continuously touch the movable element 103. Even if the thickness of the article is within the acceptable range, the movable element 103 may fully shelter the sensing light emitted from the first optical sensor 1041 and the second optical sensor 1042. Under this circumstance, the shredder 100 is subject to interruption and the shredding operation is ceased.

Therefore, there is a need to provide a shredder which has a thickness triggering device and is capable of avoiding the trembling of the shredding article.

SUMMARY OF THE INVENTION

It is an object of the present invention to provide a shredder capable of avoiding the trembling of the shredding article during the shredding operation.

In accordance with a first aspect of the present invention, there is provided a shredder. The shredder includes a shredding mechanism, a movable element and a sustaining mechanism. The shredding mechanism includes an entrance, a shredding path, a first driving assembly, a second driving assembly, a sensing assembly and a shredding knife assembly. The sensing assembly is electrically connected to the first and second driving assemblies. The entrance is disposed at a top side of the shredding mechanism for feeding an article to be shredded therethrough. The shredding path is arranged between the entrance and the shredding knife assembly. The movable element is disposed under the entrance and arranged at a lateral side of the shredding path. The article is introduced into the shredding path through the entrance to be sustained against the movable element such that the movable element is shifted to result in a shift distance with respect to its original place. The sustaining mechanism is arranged at the lateral side of the shredding path to be sustained against the article passing through the shredding path, thereby reducing the trembling degree of the article when a shredding operation is implemented on the article and maintaining the shift distance less than a threshold value. An enable signal is issued from the sensing assembly when the shift distance of the movable element is less than the threshold value. In response to the enable signal, the first driving assembly is activated to have the shredding knife assembly perform the shredding operation and the second driving assembly is activated to have the sustaining mechanism move from an initial position to a sustaining position to be sustained against the article.

In accordance with a second aspect of the present invention, there is provided a shredder. The shredder includes an entrance, a shredding knife assembly, a shredding path, a first driving assembly, a sustaining mechanism, a second driving assembly, a movable element and a sensing assembly. The shredding path is arranged between the entrance and the shredding knife assembly. The first driving assembly is used for driving the shredding knife assembly coupled thereto, so that an article is introduced into the shredding path through the entrance to be shredded by the shredding knife assembly. The sustaining mechanism is arranged at a lateral side of the shredding path. The second driving assembly is used for driving the sustaining mechanism coupled thereto, so that the sustaining mechanism is sustained against the article passing through the shredding path. The movable element is disposed under the entrance and arranged at a lateral side of the shredding path. The article is introduced into the shredding path through the entrance to be sustained against the movable element such that the movable element is shifted to result in a shift distance with respect to its original place in a first shift direction. The sensing assembly is electrically connected to the first and second driving assemblies. An enable signal is issued from the sensing assembly when the shift distance of the movable element is less than a threshold value. In response to the enable signal, the first driving assembly is activated to have the shredding knife assembly perform a shredding operation and the second driving assembly is activated to have the sustaining mechanism sustained against the article in a second direction opposite to the first direction, thereby maintaining the shift distance less than the threshold value.

In accordance with a third aspect of the present invention, there is provided a shredder. The shredder includes an entrance, a shredding knife assembly, a shredding path, a driving assembly, a movable element, a pusher element and a sensing assembly. The shredding path is arranged between the entrance and the shredding knife assembly. The driving assembly is used for driving the shredding knife assembly coupled thereto, so that an article is introduced into the shredding path through the entrance to be shredded by the shredding knife assembly. The movable element is disposed under the entrance and arranged at a lateral side of the shredding path. The article is introduced into the shredding path through the entrance to be sustained against the movable element such that the movable element is shifted to result in a shift distance with respect to its original place. The pusher element is coupled to the driving assembly and disposed in the vicinity of the movable element. The press element is disposed beside the pusher element and synchronously moved with the pusher element. The sensing assembly is electrically connected to the driving assembly. An enable signal is issued from the sensing assembly when the shift distance of the movable element is less than a threshold value. In response to the enable signal, the driving assembly is activated to have the shredding knife assembly perform a shredding operation and have the sustaining mechanism move from an initial position to a sustaining position to be sustained against the article, thereby reducing the trembling degree of the article when the shredding operation is implemented on the article and maintaining the shift distance less than the threshold value.

In an embodiment, the driving assembly includes a first motor assembly, a second motor assembly and a transmission gear set. The second motor assembly is coupled with the pusher element. The transmission gear set is interconnected between the first motor assembly and the shredding knife assembly, so that the shredding knife assembly is driven by the motor assembly to perform the shredding operation.

In an embodiment, the driving assembly includes a motor assembly, an electrical control assembly and a transmission gear set. The electrical control assembly is electrically connected to the pusher element. The transmission gear set is interconnected between the first motor assembly and the shredding knife assembly, so that the shredding knife assembly is driven by the motor assembly to perform the shredding operation.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
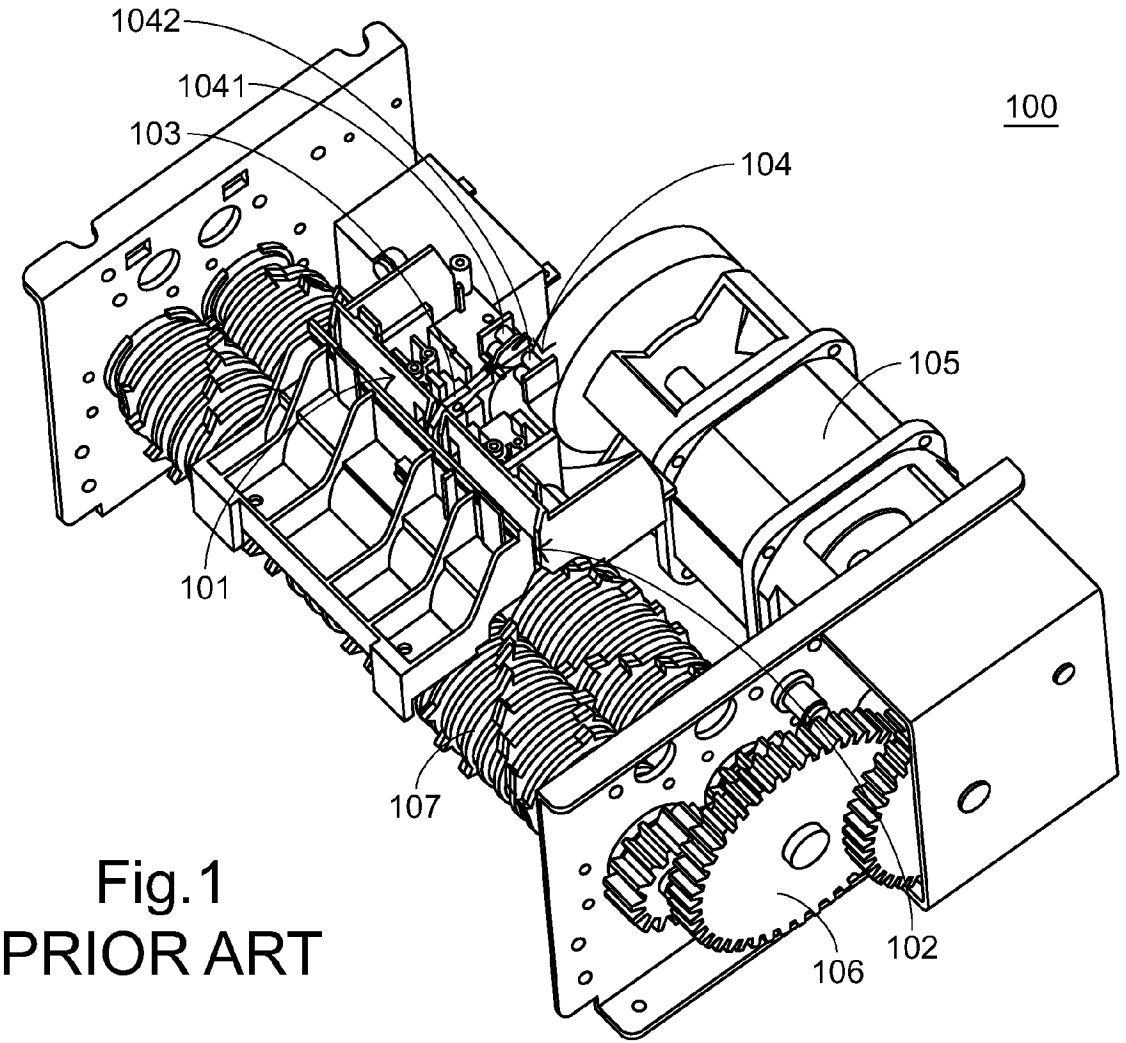
Fig.1 PRIOR ART
FIG. 1 is a schematic perspective view of a shredder having a thickness triggering device according to prior art.
Figure 2A:
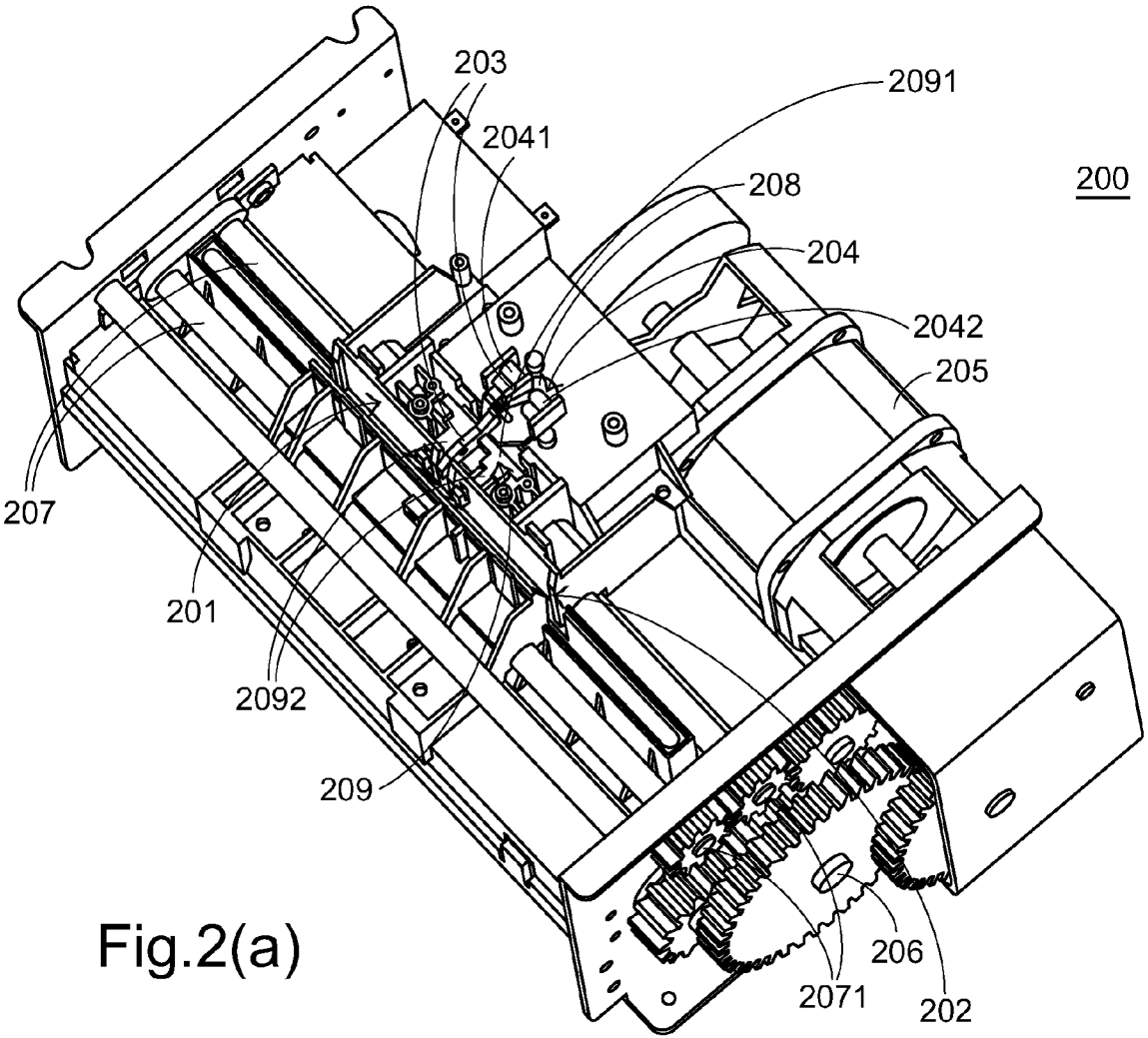
FIGS. 2(*a*), 2(*b*), 2(*c*) and 2(*d*) schematically illustrate a shredder according to a preferred embodiment of the invention taken from different directions.
Figure 2B:
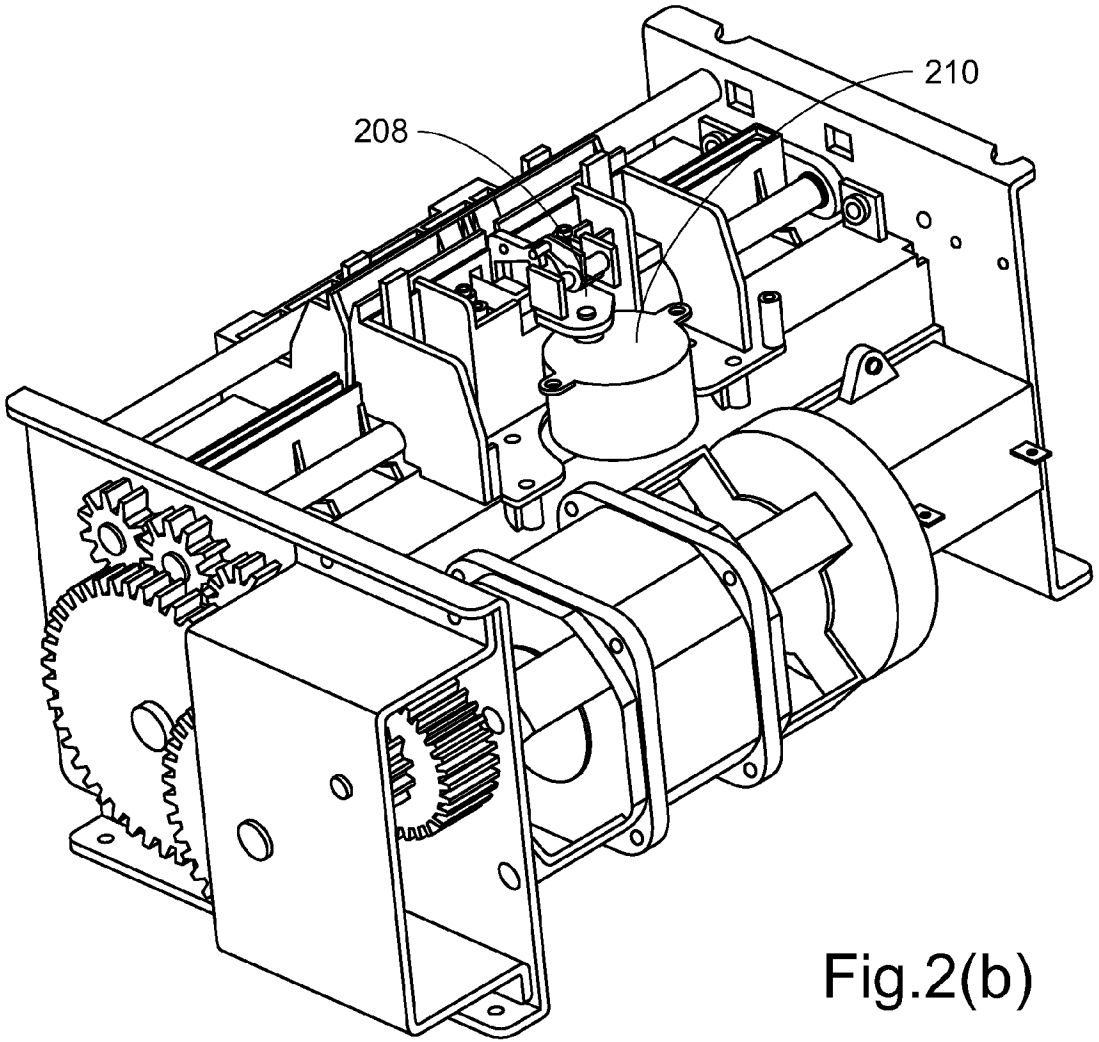
Figure 2C:
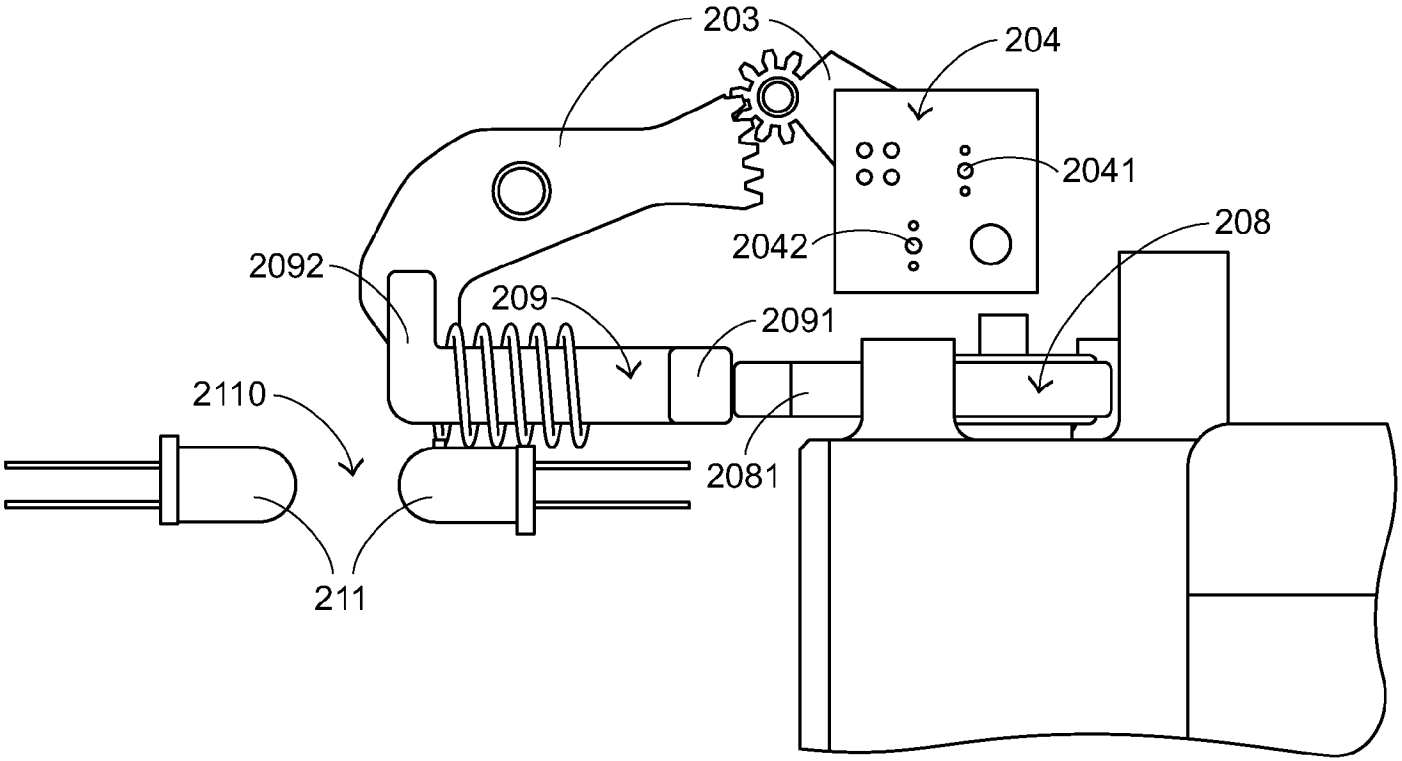
Figure 2D:
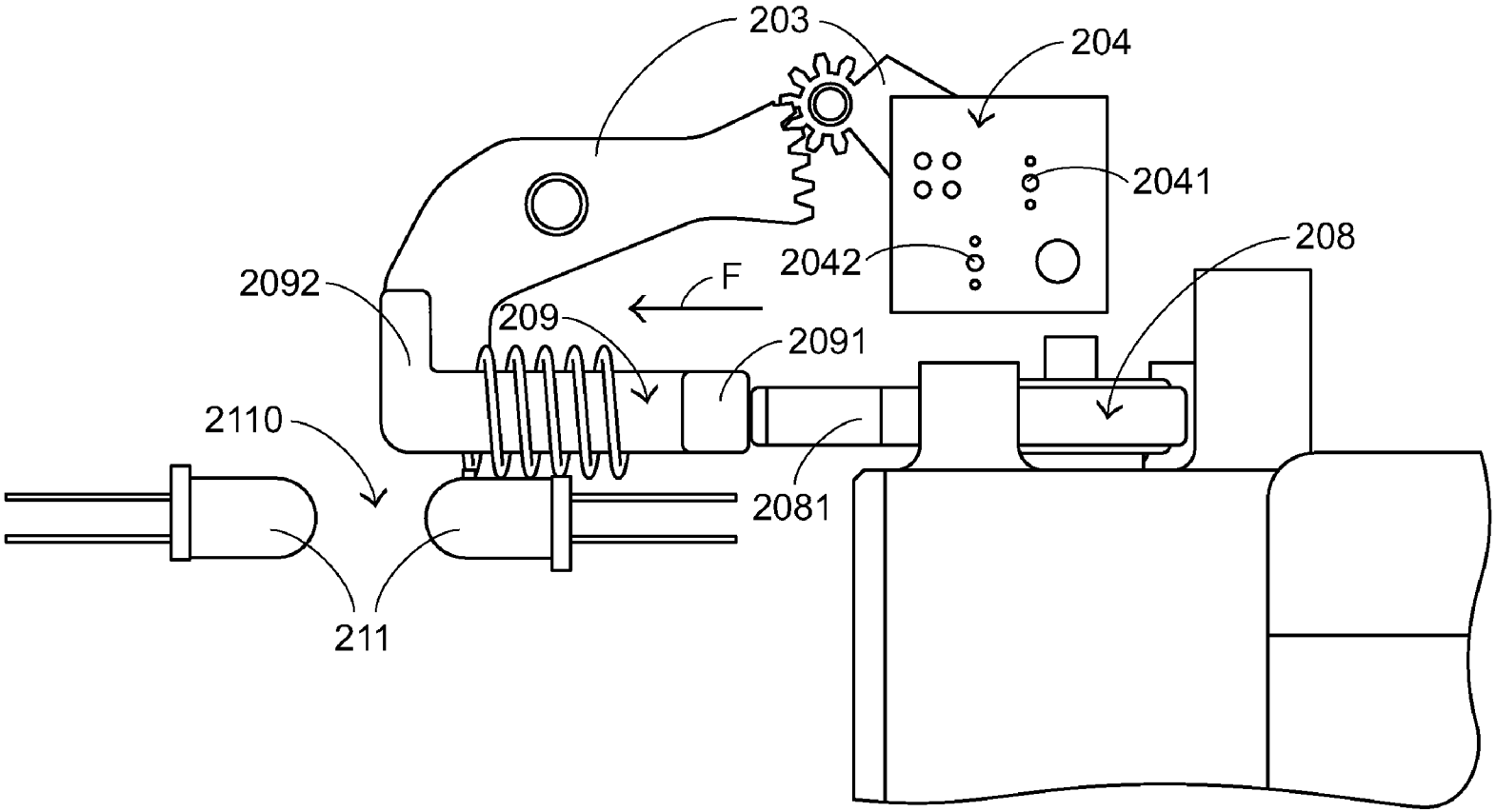

For avoiding the trembling of the shredded article during the shredding operation, the shredder of the present invention further includes a sustaining mechanism in the vicinity of the movable element. The sustaining mechanism includes a pusher element and a press element. The locations of the pusher element and the press element are varied depending on the manufactures' design. Since the sustaining mechanism is sustained against the shredding article, the influence of the shredding article on the movable element is reduced and the possibility of erroneous interruption of the shredder is reduced.

Please refer to FIGS. 2(*a*), 2(*b*), 2(*c*) and 2(*d*), which schematically illustrate a shredder according to a preferred embodiment of the invention taken from different directions. The shredder 200 includes an entrance 201, a shredding path 202, a movable element 203, a thickness sensing module 204, a first motor assembly 205, a transmission gear set 206, an eccentric cam 208, a push rod structure 209 and a second motor assembly 210.

As shown in FIG. 2(*a*), the entrance 201 is disposed above the shredding path 202. The movable element 203 is arranged at a side of the shredding path 202. The thickness sensing module 204 is disposed behind the movable element 203. The thickness sensing module 204 includes a first optical sensor 2041 and a second optical sensor 2042. The thickness sensing module 204 and the movable element 203 are cooperatively referred as a thickness triggering device. The push rod structure 209 is disposed under the movable element 203. The push rod structure 209 includes a horizontal rod 2091 and two protrusion rods 2092 such that the push rod structure 209 is U-shaped. The protrusion rods 2092 are sheathed by respective resilient elements such as springs. The eccentric cam 208 is disposed behind the U-shaped push rod structure 209. As shown in FIG. 2(*b*), the eccentric cam 208 is pivotally coupled to the second motor assembly 210, which is disposed under the eccentric cam 208. For illustration, the eccentric cam 208 may be referred as a pusher element and the U-shaped push rod structure 209 may be referred as a press element. The pusher element and the press element are cooperatively defined as a sustaining mechanism.

Likewise, a shredding knife assembly (not shown) which has a structure similar to the shredding knife assembly 107 of FIG. 1 is disposed at the outlet of the shredding path 202. The transmission gear set 206 is interconnected between this shredding knife assembly and the first motor assembly 205. The transmission gear set 206 is also engaged with this shredding knife assembly and the first motor assembly 205. As a consequence, the shredding knife assembly is driven by the first motor assembly 205 to implement a shredding operation.

In accordance with a feature of the present invention, a roller assembly 207 is arranged between the movable element 203 and the shredding knife assembly. The roller assembly 207 includes two transmission rods for confining the shredding article, thereby further reducing the trembling degree of the shredding article. The left and right ends of these two transmission rods are coupled to gears 2071. Since the gears 2071 are engaged with the transmission gear set 206, the transmission rods of the roller assembly 207 are synchronously rotated with the transmission gear set 206. Under this circumstance, the friction force possibly generated between the shredding article and the roller assembly 207 will be minimized or eliminated.

Hereinafter, the successive operations of the shredder according to the present invention will be illustrated in more details as follows.

Please refer to FIG. 2(*a*) again. First of all, an article (not shown) to be shredded is introduced into the shredding path 202 through the entrance 201. After the article is in contact with and sustained against the movable element 203, the movable element 203 is shifted backwardly to result in a shift distance with respect to its original place. The first optical sensor 2041 and the second optical sensor 2042 of the thickness sensing module 204 continuously emit sensing light. The shift distance where the movable element 203 begins to fully shelter the sensing light is referred herein as a maximum allowable shift distance. The maximum allowable shift distance should be determined according to some preliminary experiments and may be denoted as a threshold value. This threshold value indicates the upper limit of the thickness of the article to be shredded by the shredder 200.

If the shift distance of the movable element 203 is greater than the threshold value, a disable signal is issued from the thickness sensing module 204. In response to the disable signal, the operations of the first motor assembly 205 and the second motor assembly 210 are suspended. Whereas, if the shift distance of the movable element 203 is less than the threshold value, an enable signal is issued from the thickness sensing module 204. In response to the enable signal, the first motor assembly 205 and the second motor assembly 210 are operated in a standby mode. In some embodiments, the enable signal and the disable signal are high-level and low-level signals, respectively. Alternatively, the enable signal and the disable signal are low-level and high-level signals, respectively.

That is, the first motor assembly 205 is activated when the enable signal issued from the thickness sensing module 204 is transmitted to the first motor assembly 205.

Moreover, as shown in FIGS. 2(*c*) and 2(*d*), the shredder 200 further includes a shredding article sensing module 211, which is disposed under the movable element 203 but above the shredding knife assembly. In FIG. 2(*c*), the eccentric cam 208 and the push rod structure 209 are located at the initial positions. In FIG. 2(*d*), the eccentric cam 208 and the push rod structure 209 are located at the sustaining positions. In response to a driving signal issued from the shredding article sensing module 211, the first motor assembly 205 is also activated.

After the advancing article passes through a sensing region 2110 of the shredding article sensing module 211, the advancing article approaches the shredding knife assembly under the shredding article sensing module 211. During the advancing article passes through a sensing region 2110 of the shredding article sensing module 211, a driving signal is issued from the shredding article sensing module 211 to the first motor assembly 205. In response to the driving signal, the first motor assembly 205 is activated to drive rotation of the transmission gear set 206. Upon rotation of the transmission gear set 206, the shredding knife assembly is driven to the implement a shredding operation. Since the second motor assembly 210 is electrically to the first motor assembly 205, the second motor assembly 210 is also activated at that moment. Since the eccentric cam 208 is pivotally coupled to the second motor assembly 210, the eccentric cam 208 is driven by the second motor assembly 210 to rotate.

When the eccentric cam 208 is rotated, a cam surface 2081 of the eccentric cam 208 is sustained against the horizontal rod 2091 of the push rod structure 209 and the push rod structure 209 is pushed forwardly in the sustaining direction F shown in FIG. 2(*d*) and the springs sheathed around the protrusion rods 2092 are compressed. Until the protrusion rods 2092 of the push rod structure 209 are sustained against the shredding article, the push rod structure 209 is moved from the initial position (as shown in FIG. 2(*c*)) to the sustaining position (as shown in FIG. 2(*d*)).

Since the U-shaped push rod structure 209 is sustained against the shredding article, the amplitude of the trembling article is largely reduced. That is, the influence of the shredding article on the movable element 203 is reduced so as to prevent interruption of the shredder 200. Moreover, as previously described, the two transmission rods of the roller assembly 207 are also effective for reducing the trembling degree of the shredding article so as to prevent interruption of the shredder 200.

After the shredding operation is ended, the first motor assembly 205 is stopped but the second motor assembly 210 is activated to permit rotation of the eccentric cam 208. By the restoring force of the compressed springs sheathed around the protrusion rods 2092, the push rod structure 209 is moved from the sustaining position to the initial position.

In some embodiments, the first motor assembly 205 is electrically connected to the second motor assembly 210, and the second motor assembly 210 is a synchronous motor, which is synchronously rotated with the first motor assembly 205. Alternatively, the first motor assembly 205 and the second motor assembly 210 are separate components without any electrical connection therebetween. In an embodiment, the second motor assembly 210 is activated to drive rotation of the eccentric cam 208 in response to an enable signal. In another embodiment, after the enable signal has been issued from the thickness sensing module 204 for a predetermined time period, the second motor assembly 210 is activated to drive rotation of the eccentric cam 208, so that the push rod structure 209 is sustained against the shredding article. After the push rod structure 209 has been sustained against the shredding article for another predetermined time period in order to assure that the shredding operation has been completed, the eccentric cam 208 is driven to rotate again and the push rod structure 209 is moved from the sustaining position to the initial position by the restoring force of the compressed springs sheathed around the protrusion rods 2092.

Alternatively, the second motor assembly may be replaced by a solenoid valve, which includes a control portion and a stem portion. Moreover, the thickness sensing module and the shredding article sensing module can be replaced by a thickness and shredding article sensing module. An embodiment of the shredder having the solenoid valve and the thickness and shredding article sensing module will be illustrated with reference to FIG. 3.

Figure 3:
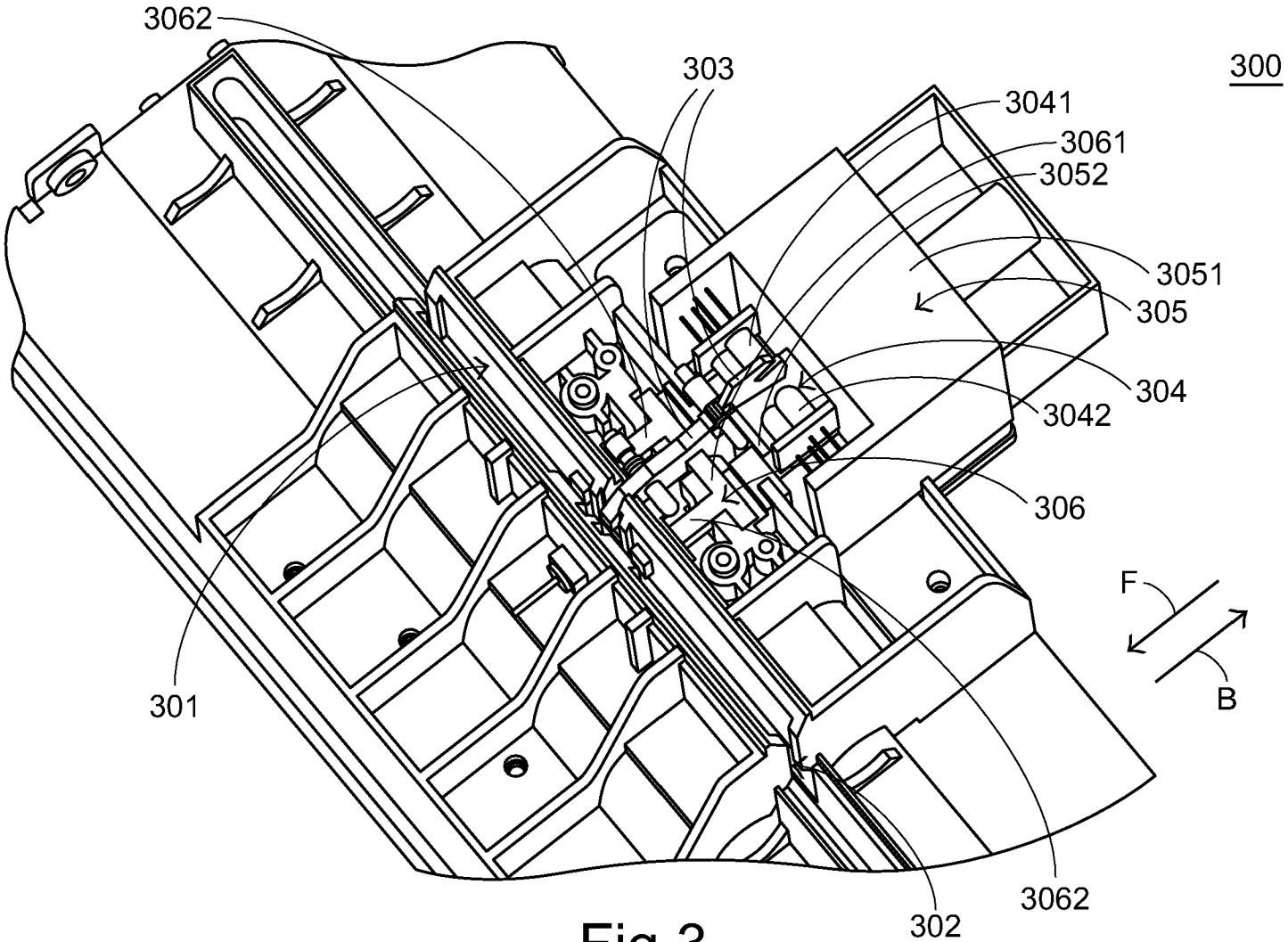
FIG. 3 is a schematic perspective view of a shredder having a thickness triggering device according to another preferred embodiment of the invention.

As shown in FIG. 3, the shredder 300 includes an entrance 301, a shredding path 302, a movable element 303, a thickness and shredding article sensing module 304, a solenoid valve 305 and a push rod structure 306.

The entrance 301 is disposed above the shredding path 302. The movable element 303 is arranged at a side of the shredding path 302. The thickness and shredding article sensing module 304 is disposed behind the movable element 303. The thickness and shredding article sensing module 304 includes a first optical sensor 3041 and a second optical sensor 3042. The thickness and shredding article sensing module 304 and the movable element 303 are cooperatively referred as a thickness triggering device. Likewise, a shredding knife assembly (not shown) which has a structure similar to the shredding knife assembly 107 of FIG. 1 is disposed at the outlet of the shredding path 302.

In comparison with the shredder 200 shown in FIGS. 2(*a*) ~2(*d*), the shredder 300 of this embodiment has no shredding article sensing module 211. As a consequence, the motor assembly (not shown) for driving shredding knife assembly is activated in response to an enable signal issued from the thickness and shredding article sensing module 304.

The solenoid valve 305 includes a control portion 3051 and a stem portion 3052. The stem portion 3052 is disposed under the movable element 303. The control portion 3051 of the solenoid valve 305 is disposed behind the stem portion 3052 and is distant from the control portion 3051.

Hereinafter, the successive operations of the shredder 300 will be illustrated in more details as follows.

Please refer to FIG. 3 again. First of all, an article (not shown) to be shredded is introduced into the shredding path 302 through the entrance 301. After the article is in contact with and sustained against the movable element 303, the movable element 303 is shifted backwardly to result in a shift distance with respect to its original place. The first optical sensor 3041 and the second optical sensor 3042 of the thickness and shredding article sensing module 304 continuously emit sensing light. The shift distance where the movable element 303 begins to fully shelter the sensing light is referred herein as a maximum allowable shift distance. Likewise, the maximum allowable shift distance should be determined according to some preliminary experiments and may be denoted as a threshold value. If the shift distance of the movable element 303 is greater than the threshold value, a disable signal is issued from the thickness and shredding article sensing module 304. In response to the disable signal, the operations of the motor assembly (not shown) and the solenoid valve 305 are suspended. Whereas, if the shift distance of the movable element 303 is less than the threshold value, an enable signal is issued from the thickness and shredding article sensing module 304. In response to the enable signal, the motor assembly is activated to have the shredding knife assembly (not shown) implement a shredding operation.

In some embodiments, after the enable signal has been issued from the thickness and shredding article sensing module 304 for a predetermined time period, the motor assembly is activated to have the shredding knife assembly (not shown) implement a shredding operation. Meanwhile, the solenoid valve 305 is synchronously activated, so that the push rod structure 306 is sustained against the shredding article. After the push rod structure 306 has been sustained against the shredding article for another predetermined time period in order to assure that the shredding operation has been completed, the solenoid valve 305 is controlled to have the push rod structure 306 moved from the sustaining position to the initial position.

Please refer to FIG. 3 again. The push rod structure 306 includes a horizontal rod 3061 and two protrusion rods 3062 such that the push rod structure 306 is U-shaped. The protrusion rods 3062 are sheathed by respective resilient elements such as springs, as are similarly disclosed in FIG. 2(*c*) and FIG. 2(*d*). Since the stem portion 3052 is distant from the control portion 3051, the stem portion 3052 fails to be pushed forwardly by the control portion 3051. Instead, under the electromagnetic control of the control portion 3051, the stem portion 3052 is moved in either a first direction (i.e. the sustaining direction F) or a second direction B (i.e. the withdrawal direction). In addition, the horizontal rod 3061 of the push rod structure 306 is coupled to the stem portion 3052 of the solenoid valve 305. As a consequence, the push rod structure 306 is synchronously moved with the stem portion 3052.

Under the electromagnetic control of the control portion 3051, the stem portion 3052 is moved in the sustaining direction F such that the protrusion rods 3062 of the push rod structure 306 are sustained against the shredding article. After the shredding operation is ended, the push rod structure 306 is moved from the sustaining position to the initial position in the withdrawal direction B due to the restoring force of the compressed springs sheathed around the protrusion rods 3062.

From the above description, the thickness triggering device of the present shredder is effective for avoiding the trembling of the article during the shredding operation. Since the sustaining mechanism is sustained against the shredding article, the amplitude of the trembling article is largely reduced. As a consequence, the influence of the shredding article on the thickness triggering device is reduced so as to prevent interruption of the shredder.

It is noted that, however, those skilled in the art will readily observe that numerous modifications and alterations may be made while retaining the teachings of the invention. For example, the two transmission rods of the roller assembly 207 may be closer to the movable element 203 or 303, so that the effect of reducing the trembling degree of the shredding article is more While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A shredder comprising:

a shredding mechanism including an entrance, a shredding path, a first driving assembly, a second driving assembly, a sensing assembly and a shredding knife assembly, wherein said sensing assembly is electrically connected to said first and second driving assemblies, said entrance is disposed at a top side of said shredding mechanism for feeding an article to be shredded therethrough, and said shredding path is arranged between said entrance and said shredding knife assembly;

a movable element disposed under said entrance and arranged at a lateral side of said shredding path, wherein said article is introduced into said shredding path through said entrance to be sustained against said movable element such that said movable element is shifted to result in a shift distance with respect to its original place; and a sustaining mechanism arranged at said lateral side of said shredding path to be sustained against said article passing through said shredding path, thereby reducing the trembling degree of said article when a shredding operation is implemented on said article and maintaining said shift distance less than a threshold value, wherein an enable signal is issued from said sensing assembly when said shift distance of said movable element is less than said threshold value, and in response to said enable signal, said first driving assembly is activated to have said shredding knife assembly perform said shredding operation and said second driving assembly is activated to have said sustaining mechanism move from an initial position to a sustaining position to be sustained against said article.

2. The shredder according to claim 1 further comprising a transmission gear set engaged with said shredding knife assembly to drive said shredding knife assembly.

3. The shredder according to claim 1 wherein said first driving assembly is a first motor assembly, and said second driving assembly is a second motor assembly coupled with said sustaining mechanism.

4. The shredder according to claim 3 wherein said second motor assembly is activated to have said sustaining mechanism sustained against said article after the enable signal has been issued from said sensing assembly for a predetermined time period, and said sustaining mechanism is returned from said sustaining position to said initial position after said sustaining mechanism has been sustained against said article for another predetermined time period.

5. The shredder according to claim 3 wherein said second motor assembly is electrically connected to said first motor assembly and synchronously activated with said first motor assembly in response to said enable signal issued from said sensing assembly so as to have said sustaining mechanism sustained against said article, and said sustaining mechanism is returned from said sustaining position to said initial position when said first motor assembly is stopped.

6. The shredder according to claim 3 wherein said sustaining mechanism comprises:

a pusher element coupled to said second motor assembly and disposed in the vicinity of said movable element, and driven by said second motor assembly to rotate; and a press element beside and in contact with said pusher element, wherein said press element is sustained against said article upon rotation of said pusher element to a certain extent.

7. The shredder according to claim 6 wherein said pusher element is an eccentric cam, and said press element is a U-shaped push rod structure including a horizontal rod and two protrusion rods, said two protrusion rods is sheathed by respective resilient elements, and a cam surface of said eccentric cam is sustained against said horizontal rod to compress said resilient elements such that said protrusion rods of said push rod structure are sustained against said article.

8. The shredder according to claim 1 wherein said first driving assembly is a motor assembly, and said second driving assembly is an electrical control assembly, which is electrically connected to said sustaining mechanism.

9. The shredder according to claim 8 wherein said electrical control assembly is activated to have said sustaining mechanism sustained against said article after said enable signal has been issued from said sensing assembly for a predetermined time period, and said sustaining mechanism is returned from said sustaining position to said initial position after said sustaining mechanism has been sustained against said article for another predetermined time period.

10. The shredder according to claim 8 wherein said electrical control assembly is electrically connected to said motor assembly and synchronously activated with said first motor assembly in response to said enable signal issued from said sensing assembly so as to have said sustaining mechanism sustained against said article, and said sustaining mechanism is returned from said sustaining position to said initial position when said motor assembly is stopped.

11. The shredder according to claim 10 wherein said electrical control assembly is a solenoid valve including a control portion and a stem portion, wherein said stem portion is distant from the control portion and said stem portion is electromagnetically controlled by said control portion.

12. The shredder according to claim 11 wherein said sustaining mechanism comprises a U-shaped push rod structure including a horizontal rod and two protrusion rods, said two protrusion rods is sheathed by respective resilient elements, said horizontal rod is coupled to said stem portion of said solenoid valve, and said push rod structure is synchronously moved with said stem portion of said solenoid valve to compress said resilient elements such that said protrusion rods of said push rod structure are sustained against said article.

13. The shredder according to claim 1 wherein said sensing assembly comprises:

a thickness sensing module electrically connected to said first and second driving assemblies for issuing said enable signal when said shift distance of said movable element is less than said threshold value, wherein in response to said enable signal, said first driving assembly and said second driving assembly are activated to drive said shredding knife assembly and said sustaining mechanism, respectively; and a shredding article sensing module disposed above said shredding knife assembly and beside said shredding path and electrically connected to said first driving assembly, wherein said first driving assembly is activated to drive said shredding knife assembly when said enable signal has been issued from said thickness sensing module and said article approaches said shredding knife assembly.

14. The shredder according to claim 13 wherein said movable element and said thickness sensing module are cooperatively defined as a thickness triggering device.

15. The shredder according to claim 13 wherein a disable signal is issued from said thickness sensing module if said shift distance of said movable element is greater than said threshold value, wherein in response to said disable signal, said first driving assembly and said second driving assembly are disabled and the operations of said shredding knife assembly and said sustaining mechanism are suspended.

16. The shredder according to claim 1 wherein said sensing assembly includes a thickness and shredding article sensing module, which is disposed above said shredding knife assembly and beside said shredding path.

17. The shredder according to claim 16 wherein said movable element and said thickness and shredding article sensing module are cooperatively defined as a thickness triggering and sensing device.

18. The shredder according to claim 16 wherein a disable signal is issued from said thickness and shredding article sensing module if said shift distance of said movable element is greater than said threshold value, wherein in response to said disable signal, said first driving assembly and said second driving assembly are disabled and the operations of said shredding knife assembly and said sustaining mechanism are suspended.

19. A shredder comprising:

an entrance;

a shredding knife assembly;

a shredding path arranged between said entrance and said shredding knife assembly;

a first driving assembly for driving said shredding knife assembly coupled thereto, so that an article is introduced into said shredding path through said entrance to be shredded by said shredding knife assembly;

a sustaining mechanism arranged at a lateral side of said shredding path;

a second driving assembly for driving said sustaining mechanism coupled thereto, so that said sustaining mechanism is sustained against said article passing through said shredding path;

a movable element disposed under said entrance and arranged at a lateral side of said shredding path, wherein said article is introduced into said shredding path through said entrance to be sustained against said movable element such that said movable element is shifted to result in a shift distance with respect to its original place in a first shift direction; and a sensing assembly electrically connected to said first and second driving assemblies, wherein an enable signal is issued from said sensing assembly when said shift distance of said movable element is less than a threshold value, and in response to said enable signal, said first driving assembly is activated to have said shredding knife assembly perform a shredding operation and said second driving assembly is activated to have said sustaining mechanism sustained against said article in a second direction opposite to said first direction, thereby maintaining said shift distance less than said threshold value.

20. A shredder comprising:

an entrance;

a shredding knife assembly;

a shredding path arranged between said entrance and said shredding knife assembly;

a driving assembly for driving said shredding knife assembly coupled thereto, so that an article is introduced into said shredding path through said entrance to be shredded by said shredding knife assembly;

a movable element disposed under said entrance and arranged at a lateral side of said shredding path, wherein said article is introduced into said shredding path through said entrance to be sustained against said movable element such that said movable element is shifted to result in a shift distance with respect to its original place;

a pusher element coupled to said driving assembly and disposed in the vicinity of said movable element;

a press element beside said pusher element and synchronously moved with said pusher element; and a sensing assembly electrically connected to said driving assembly, wherein an enable signal is issued from said sensing assembly when said shift distance of said movable element is less than a threshold value, and in response to said enable signal, said driving assembly is activated to have said shredding knife assembly perform a shredding operation and have said sustaining mechanism move from an initial position to a sustaining position to be sustained against said article, thereby reducing the trembling degree of said article when said shredding operation is implemented on said article and maintaining said shift distance less than said threshold value.

21. The shredder according to claim 20 wherein said driving assembly includes:

a first motor assembly;

a second motor assembly coupled with said pusher element; and a transmission gear set interconnected between said first motor assembly and said shredding knife assembly, so that said shredding knife assembly is driven by said motor assembly to perform said shredding operation.

22. The shredder according to claim 20 wherein said driving assembly includes:

a motor assembly;

an electrical control assembly electrically connected to said pusher element; and a transmission gear set interconnected between said first motor assembly and said shredding knife assembly, so that said shredding knife assembly is driven by said motor assembly to perform said shredding operation.

* * * * *

UNITED STATES PATENT AND TRADEMARK OFFICE

CERTIFICATE OF CORRECTION

PATENT NO. : 7,661,612 B2
APPLICATION NO. : 11/625518
DATED : February 16, 2010
INVENTOR(S) : Lee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 312 days.

Signed and Sealed this

Thirtieth Day of November, 2010

David J. Kappos

David J. Kappos
*Director of the United States Patent and Trademark Office*